United States Patent [19]

Liebel

[11] Patent Number: 5,069,359

[45] Date of Patent: Dec. 3, 1991

[54] SHIPPING CONTAINER

[76] Inventor: Henry L. Liebel, 9200 Cunningham Rd., Cincinnati, Ohio 45243

[21] Appl. No.: 710,659

[22] Filed: Jun. 5, 1991

[51] Int. Cl.[5] ..... B65D 5/50; B65D 5/56

[52] U.S. Cl. ..... 220/441; 220/462; 222/105; 229/23 R

[58] Field of Search ..... 229/23 R; 220/415, 416, 220/441, 462, 465; 206/503, 591; 222/105, 107, 538, 540

[56] References Cited

U.S. PATENT DOCUMENTS

| | | | |
|---|---|---|---|
| 3,648,920 | 3/1972 | Stump | 220/441 |
| 4,421,253 | 12/1983 | Croley | 222/105 |
| 4,516,692 | 5/1985 | Croley | 222/105 |
| 4,623,075 | 11/1986 | Riley | 222/105 |
| 4,729,505 | 3/1988 | Remaks et al. | 220/441 |
| 4,742,951 | 5/1988 | Kelly et al. | 220/441 |
| 4,919,306 | 4/1990 | Heaps, Jr. et al. | 220/462 |

FOREIGN PATENT DOCUMENTS

| | | | |
|---|---|---|---|
| 703631 | 2/1965 | Canada | 220/441 |
| 79762 | 2/1952 | Norway | 220/441 |
| 965221 | 7/1964 | United Kingdom | 220/441 |

*Primary Examiner*—Gary E. Elkins

*Attorney, Agent, or Firm*—Wood, Herron & Evans

[57] ABSTRACT

A shipping container for shipping particularly liquids in bulk loads including an outer corrugated box, an inner cylindrical paper tube extending to the inner walls of the box, triangular-shaped corner posts disposed between the inner tube and the outer corrugated box at the corners thereof. The container is characterized by its significantly increased resistance to outward bulging of the side walls by the weight of the liquid contained therein.

6 Claims, 2 Drawing Sheets

SHIPPING CONTAINER

BACKGROUND OF THE INVENTION

This invention relates to an improved shipping container and, more particularly to an improved shipping container particularly adapted for the shipping of liquids in bulk.

In the transport of bulk materials in liquid form, such as in the shipping of liquid glues for industrial use, such materials are typically shipped in containers having side walls formed, for example, of corrugated cardboard. Because of the large outward forces imposed on the container by the bulk liquid, which is typically contained in a plastic bag in the container, considerable effort and expense has gone into attempts to contain these bulging forces. For example, in one commercially available design, the container is in the shape of a polygon which is strapped with metal reinforcing straps about its circumference. However, such solutions are not always successful and entail an added cost of the container.

In my U.S. Pat. No. 4,890,787, there is described an improved shipping container adapted particularly for transporting loads of material in pelletized, granular, powdered, or other particulate form. That container included an outer tube formed of four corrugated paperboard side walls and an inner tube which is formed in the shape of a cylinder open at both ends. The diameter of the inner cylinder is equal to the width of at least two of the side walls such that the cylinder extends generally to at least two of the side walls. The inner cylinder may be constructed out of laminated kraft paper of two or three plys and having a thickness from about 0.016 to 0.060 inch which is formed into the shape of an open-ended cylinder and glued to itself along an overlapping seam. The container is designed such that the material being shipped fills the interior of the inner cylinder and also the corner areas between the outer wall of the inner cylinder and the side walls. Still further the cylinder may be glued to two sides of the side wall such that in the knocked-down condition of the cylinder with the container flattened, the tube is likewise flattened. This permits the container to be stacked and shipped in a flat condition saving substantially on shipping space. However, when the container is erected, the inner tube immediately takes its cylindrical configuration.

It has now been found that the shipping container as described may be improved to make a shipping container particularly adapted for shipping of liquids in bulk with significantly increased resistance to outward bulging due to the weight of the liquid contained therein.

SUMMARY OF THE INVENTION

The present invention accordingly contemplates a new construction to provide a shipping container particularly adapted for shipping liquids in bulk which has a significantly increased resistance to bulging under the weight of the material contained in the container. In a presently preferred form of the invention, the container comprises an outer tube formed of four corrugated paperboard side walls having generally rectangular sides of equal width and an inner tube which is formed in the shape of a cylinder open at both ends. The diameter of the inner cylinder is equal to the width of the side walls such that the inner cylinder extends generally to the side walls. The inner cylinder may be constructed out of laminated kraft paper of 2–8 plys and having a total thickness from about 0.040 to 0.100 inch which is formed into the shape of an open ended cylinder and glued to itself along an overlapping seam. Generally, the outer tube is 42 to 45 inches square. Triangular-shaped posts are disposed in the corners of the outer corrugated tube between the inner tube and the sides of the outer tube. The corner posts are so dimensioned as to make tangential contact with the inner tube for resisting bulging of the inner tube by the weight of material contained therein.

A plastic bag containing a bottom valve is inserted into the inner paper tube with the valve protruding into the interior of one of the triangular posts at the corner. The construction is completed by top and bottom caps enclosing the top and bottom respectively of the outer tube.

The inner tube may be glued to two sides of the outer tube side wall such that in the knocked-down condition of the container with the container flattened, the inner tube is likewise flattened. This permits the container to be stacked and shipped in a flat condition saving substantially on shipping space. However, when the container is erected, the inner tube immediately takes its cylindrical configuration. The triangular-shaped corner posts may likewise be shipped flat and then erected and disposed in the corners of the outer tube. The plastic bag is placed in the inner tube and the filling of the bag commenced.

It has been found surprisingly that the container construction of the present invention has significantly increased resistance to outward bulging due to the weight of the liquid contained therein and, as such, eliminates the reinforcing straps heretofore used in shipping bulk loads of liquid. Further, the present invention comprises basically a simple square box thus facilitating manufacture and assembly.

DETAILED DESCRIPTION OF THE INVENTION

Figure 1:
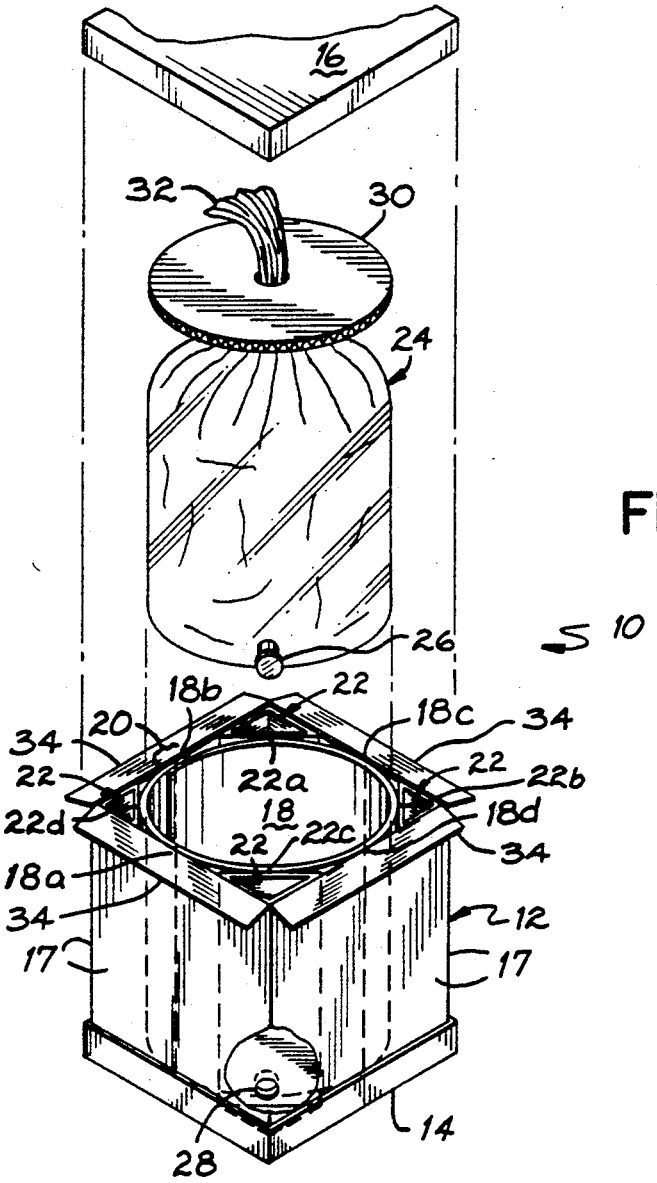
FIG. 1 is an exploded isometric view with parts broken away of one embodiment of the present invention.

Referring now to FIG. 1, the shipping container 10 of the present invention includes an outer tube 12, a bottom cap 14, and a top cap 16. The outer tube 12 is formed with four sides 17 of a suitable container material such as single, double, or triple wall corrugated paperboard. For example, the outer tube 12 may be formed of 350 to 500 pound test B or C flute corrugated board. A typical construction of the outer tube 12 comprises four equally dimensioned side walls 17 on the order of 42 to 45 inches square. It is preferred that the side walls 17 be of equal width. However, the height of the side walls 17 can be other dimensions so as to form a rectangle.

Within the side wall 17 of the container 10 is an open ended cylindrical tube 18. As shown in the embodiment illustrated in the Figs., the side walls 17 have equal widths and the cylindrical tube 18 has a diameter equaling generally the width of the side walls 17 of the container 10 such that the tube 18 extends to and abuts against the side walls of the tube 10 from top to bottom at four equally spaced locations 18*a, b, c* and *d*.

In one embodiment of the invention, the inner tube 18 is formed of linerboard which is wrapped upon itself with the last ply being glued to the underlying linerboard at 20. For example, linerboard typically comes in a thickness of 0.016 inch. This material may be wrapped on itself to give an inner tube 18 having a thickness of about 0.080 inch. Generally, it is desired that the total thickness of the inner tube be in the range of 0.040 to 0.100 inch and formed of from 2 to 8 plys, but not necessarily laminated together.

Four triangular-shaped corner posts 22 are inserted between the inner tube 18 and the outer tube 12 at the interior corners of the outer tube 12 making tangential contact with the inner tube 18 at four equally spaced points 22*a, b, c, d*. The triangular-shaped corner posts 22 may be formed from the same material as the outer tube 12. The four corner posts provide for increased resistance to outward bulging of the inner tube 18.

Figure 2:
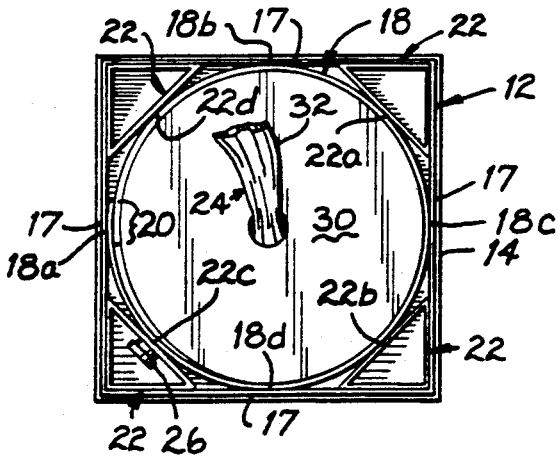
FIG. 2 is a top view of the container shown in FIG. 1 with top cap removed.
Figure 3:
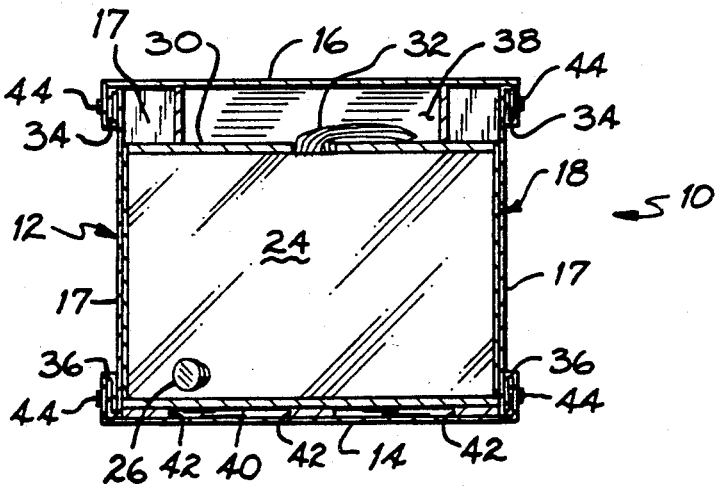
FIG. 3 is a cross-sectional view of the container shown in FIG. 1.

A plastic bag 24, for example, formed of vinyl, having a bottom valve 26 is inserted into the inner tube 18 with the valve 26 protruding through a cutout 28 in the inner tube 18 and adjacent corner post 22. The plastic bag 24 may be filled from the top. When filled and closed, a corrugated annular insert 30 fits down along the walls of the inner tube 18 with the closed end 32 of the plastic bag 24 protruding therethrough (FIG. 2). The top cap 16 then fits over the outer tube 12 to close the assembly. The outer tube 12 may be provided with four flanges 34 for engagement in interlocking relation with the top cap 16 (FIG. 3). Additionally, the bottom of the outer tube 12 may be provided with like interlocking flanges 36 for a full flange interlocked bottom construction, if desired (FIG. 3).

Referring now to FIG. 3, the top cap 16 may be provided with a corrugated spacer 38 adhered to the inner surface thereof. The spacer 38 is in the shape of a square having a diagonal dimension equal to the inner diameter of the inner tube 18. The spacer 38 engages the annular insert 30 to tightly contain the liquid to prevent its sloshing during transport.

In addition, the bottom of the plastic bag 24 may be spaced upwardly from the bottoms of the inner and outer tubes 12, 18 by the use of an annular corrugated insert 40 supported by corrugated spacing members 42 spaced thereabout between the corrugated spacer 30 and the bottom cap 14.

Figure 4:
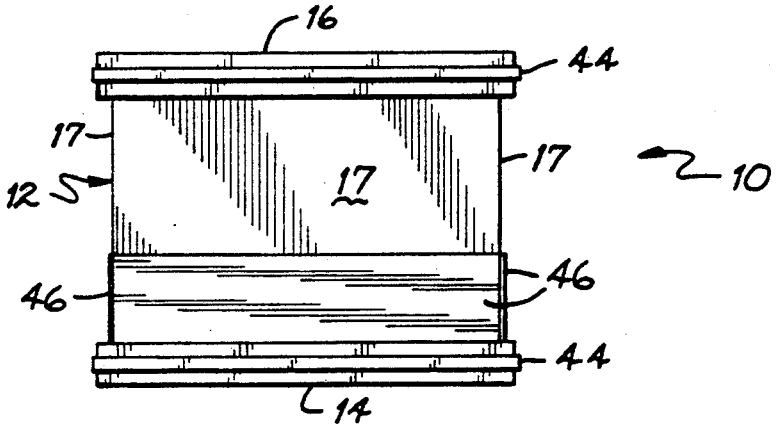
FIG. 4 is a side elevational view of an alternative embodiment of the present invention.

Referring now in addition to FIG. 4, the top cap 16 and bottom cap 14 are typically tightly secured by metal or plastic straps 44 passing around the outside. To prevent puncture damage to the container 10 and possible leakage of the liquid contained therein, the lower portion of the outside surface of the outer tube 12 may be lined with hardboard 46 so as to prevent puncture by the tines of forklift trucks and the like.

Figure 5:
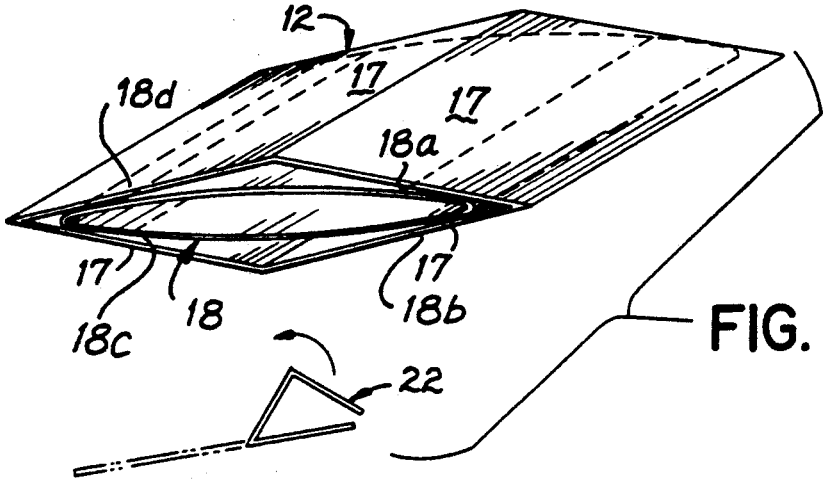
FIG. 5 is an isometric schematic illustrating the container in a knocked-down condition.

Referring in addition to FIG. 5, the inner tube 18 is desirably secured to opposed side walls 17 of the outer tube 12 such as by gluing along glue lines 18*a*, 18*c* to the inside of two sides 17 thereof. The inner tube 18 being formed of linerboard or other glueable material may be folded along with the outer tube 12 to permit shipping of the container in a flat condition. Once the container is erected as the outward corners of the outer tube 12 are brought together, the inner tube 18 forms into its cylindrical configuration shown in FIG. 1. Once erected, the corner posts 22, which also may be shipped flat, are folded to a triangular shape and inserted in the four corners of the outer tube 12. The plastic bag 24, which likewise is shipped flat, is inserted into the inner tube 12 with the bottom valve 26 protruding through the cut out 28 in the inner tube 12 and one of the corner posts 22, as illustrated in FIGS. 1 and 2. After filling of the plastic bag 24 and closing at 32, the corrugated insert 30 then fits down into the inner tube 18, and the top 16 is placed thereon which may include the top spacer 38 shown in FIG. 3.

On receipt of the shipped container, the user need only to cut through the side wall 17 of the outer tube 12 and corner post 22 at the corner indicated as having the valve 26 and a hose attached to the valve 26 to drain the container.

Thus, having described the invention what is claimed is:

1. A shipping container adapted particularly for shipping liquids in bulk, comprising:

a four sided outer paper tube having generally rectangular sides of generally equal width;

a generally cylindrical inner tube means within said outer paper tube having a diameter generally equal to the width separating the opposed pairs of sides of said outer paper tube and being adapted to expand towards said opposed pair of sides of said outer paper tube and defining an interior area for receiving material to be contained therein;

triangular-shaped posts disposed in the corners of said outer paper tube between said inner tube means and said sides of said outer paper tube, said inserts being so dimensioned to make tangential contact with said inner tube means for resisting bulging of said inner tube means by the weight of material contained therein;

said inner tube means being adhered to at least one side of said outer paper tube, said outer paper tube and said inner tube means being foldable to a knocked-down position to be stacked and shipped in a substantially flat condition and to be erected for use.

2. The shipping container of claim 1 wherein said sides are of substantially equal width and height.

3. A shipping container adapted particularly for shipping liquids in bulk, comprising:

a four sided outer paper tube having generally rectangular sides of generally equal width;

a generally cylindrical inner tube means within said outer paper tube having a diameter generally equal to the width separating the opposed pairs of sides of said outer paper tube and being adapted to expand towards said opposed pair of sides of said outer paper tube and defining an interior area for receiving material to be contained therein;

triangular-shaped posts disposed in the corners of said outer paper tube between said inner tube means and said sides of said outer paper tube, said inserts being so dimensioned to make tangential contact with said inner tube means for resisting bulging of said inner tube means by the weight of material contained therein;

said outer paper tube and said inner tube means being foldable to a knocked-down position to be stacked and shipped in a substantially flat condition and to be erected for use.

4. The shipping container of claim 3 wherein said inner tube means comprises from two to eight plys of kraft paper having a total thickness of from about 0.040 to 0.100 inch.

5. The shipping container of claim 3 further comprising a plastic bag interior of said cylindrical inner tube means, said bag including a valve extending through the wall of said inner tube means and a wall of one of said triangular-shaped posts.

6. The shipping container of claim 5 further comprising an annular insert having a diameter generally equal to the diameter of said inner tube means insertable in said inner tube means to be received on said plastic bag when filled, a top receivable on said outer paper tube, and means between said annular insert and said top for bracing said insert against said liquid-filled bag to prevent sloshing of said liquid in said container.

* * * * *